US010882686B2

(12) United States Patent
Berry et al.

(10) Patent No.: US 10,882,686 B2
(45) Date of Patent: Jan. 5, 2021

(54) CONTAINER

(71) Applicants: Ann Berry, Hot Springs Village, AR (US); Dolores Donovan, Hot Springs Village, AR (US)

(72) Inventors: Ann Berry, Hot Springs Village, AR (US); Dolores Donovan, Hot Springs Village, AR (US)

( * ) Notice: Subject to any disclaimer, the term of this patent is extended or adjusted under 35 U.S.C. 154(b) by 0 days.

(21) Appl. No.: 15/968,741

(22) Filed: May 1, 2018

(65) Prior Publication Data

US 2019/0337709 A1 Nov. 7, 2019

(51) Int. Cl.
*B65D 83/08* (2006.01)

(52) U.S. Cl.
CPC ..... *B65D 83/0888* (2013.01); *B65D 83/0805* (2013.01)

(58) Field of Classification Search
CPC ..... B65D 83/0888; B65D 83/0805
USPC ..... 206/494
See application file for complete search history.

(56) References Cited

U.S. PATENT DOCUMENTS 2,349,488 A * 5/1944 Dement ..... A24F 27/12 206/117
3,089,586 A * 5/1963 Cole ..... B65D 83/0888 206/216
3,331,498 A * 7/1967 Davies ..... A47K 10/24 206/494
4,919,302 A * 4/1990 McPherson ..... A47K 10/28 221/102
5,020,711 A * 6/1991 Kelley ..... A61F 7/02 224/222
5,170,917 A * 12/1992 Tourigny ..... A45C 1/04 224/219
6,446,803 B1 * 9/2002 McKinney ..... B42D 9/004 116/239
7,490,734 B2 * 2/2009 Carr ..... A47K 10/421 221/102
2002/0175094 A1 * 11/2002 Campbell ..... B65D 83/0888 206/233
2005/0173285 A1 * 8/2005 Moncrief ..... A47K 10/426 206/460
2018/0228321 A1 * 8/2018 Kurker ..... A47K 10/185

* cited by examiner

*Primary Examiner* — Luan K Bui

(74) *Attorney, Agent, or Firm* — Garrett James O'Sullivan

(57) ABSTRACT

A container comprises a body defined by a top and bottom, wherein the top and bottom are separated by one or more sidewalls, wherein the top has an opening extending into a hollow interior. a plurality of material strips are sequentially disposed within the body, wherein the plurality of material strips are removed from within the body in sequential order A secondary container is in communication with the body, wherein the secondary container receives each of the plurality of strips after they have been removed from the body.

6 Claims, 3 Drawing Sheets

CONTAINER

CROSS-REFERENCE TO RELATED APPLICATION(S)

Not applicable

BACKGROUND OF THE INVENTION

1. Field of Invention

The present invention relates to the field of containers and more particularly to containers used for antibacterial wipes or devices contained therein.

2. Description of Related Art

Skin is the human body's first physical barrier of defense against pathogens. Selective permeability allows the skin to regulate the ingress and egress of materials inside and out of the body. Pores, openings, orifices, and wounds are all examples of discontinuous areas of the skin allowing for uncontrolled regulation of potentially harmful pathogens into and out of the body.

Hands come in contact with a large number of surfaces. These surfaces may contain pathogens that are then transported by the hands to other areas of the skin, and ultimately into the body. While washing hands may be sufficient to eliminate some of the microbes on the hands, antimicrobial and antibacterial solutions are generally more efficient and effective.

Current solutions may be provided in separate bottles which the user is required to carry with them. Other solutions may be provided in a saturated piece of material that is used to wash the users hands.

One example can be seen in U.S. patent application Ser. No. 13/239,763 entitled "Tissue Container with a Sanitary Waste Tissue Disposal Compartment", by Maryjane R. Day, which discloses a new and novel tissue container having at least two separate and distinct compartments, one for dispensing clean tissues and one for receiving and retaining used tissues in protected compartment designed to secure and/or disinfect germs resident in such used tissues. However, the compartment would promote the formation and colonization of germs.

With any current attempt in the art to address these dangerous health issues, a user is required to retain supplemental containers or have access to separate containers for disposal of the used material after washing their hands. Further, where wipes are provided without antimicrobial solutions, the user is limited to the efficacy of untreated wipes and/or water.

Based on the foregoing, there is a need in the art for a system that will provide a comprehensive germ containment unit having separate antimicrobial dispersing device or impregnated materials.

SUMMARY OF THE INVENTION

A container comprises a body defined by a top and bottom, wherein the top and bottom are separated by one or more sidewalls, wherein the top has an opening extending into a hollow interior. a plurality of material strips are sequentially disposed within the body, wherein the plurality of material strips are removed from within the body in sequential order A secondary container is in communication with the body, wherein the secondary container receives each of the plurality of strips after they have been removed from the body.

In an embodiment, the secondary container is releasably engaged to the body, wherein the secondary container is attached to an elastic loop of material, wherein the elastic loop of material engages an exterior of the one or more sidewalls.

In an embodiment, the secondary container is hingedly attached to an exterior of at least one of the one or more sidewalls, wherein the secondary container is selectively opened to receive each of the plurality of the material strips.

In an embodiment, the secondary container is spring biased towards the one or more sidewall to which it is hingedly attached, wherein the secondary container is opened by sufficient force in opposition to the spring bias.

In an embodiment, the secondary container is retained in a closed position by a locking mechanism attached to the one or more sidewalls.

In an embodiment, the container further comprises a retention mechanism configured to retain one or more antibacterial compounds, wherein the retention mechanism is attached to the elastic loop of material.

In an embodiment, the retention mechanism engages an object, wherein the object is a separate container containing the one or more antibacterial compounds.

In an embodiment, the elastic loop has a dynamic circumference, wherein the dynamic circumference is configured to adapt to the body, wherein the dynamic circumference engages a perimeter of the body by friction engagement.

In an embodiment, the container further comprises one or more clips facilitating an engagement between the body and the elastic loop of material.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
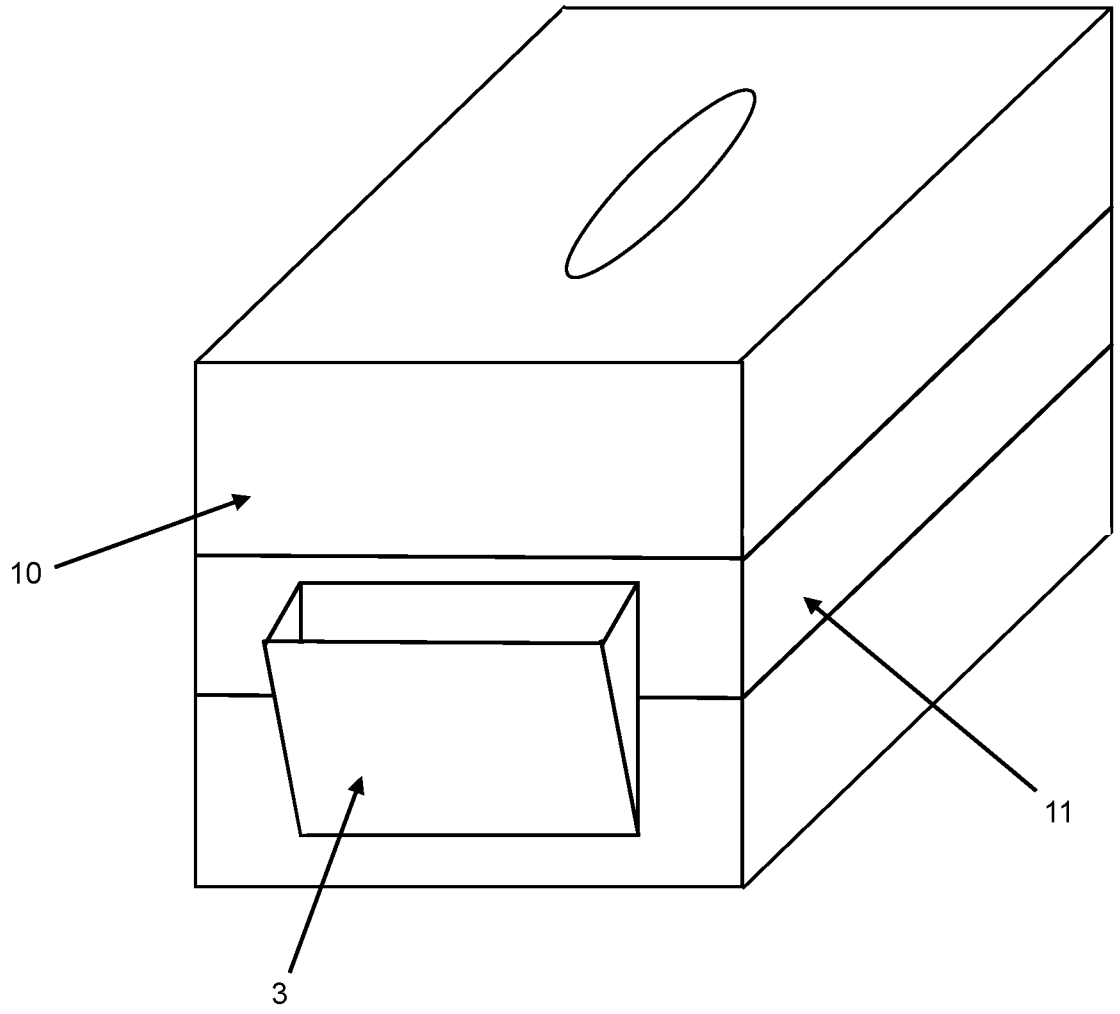
FIG. 1 is a perspective view of the container, according to an embodiment of the present invention.
Figure 2:
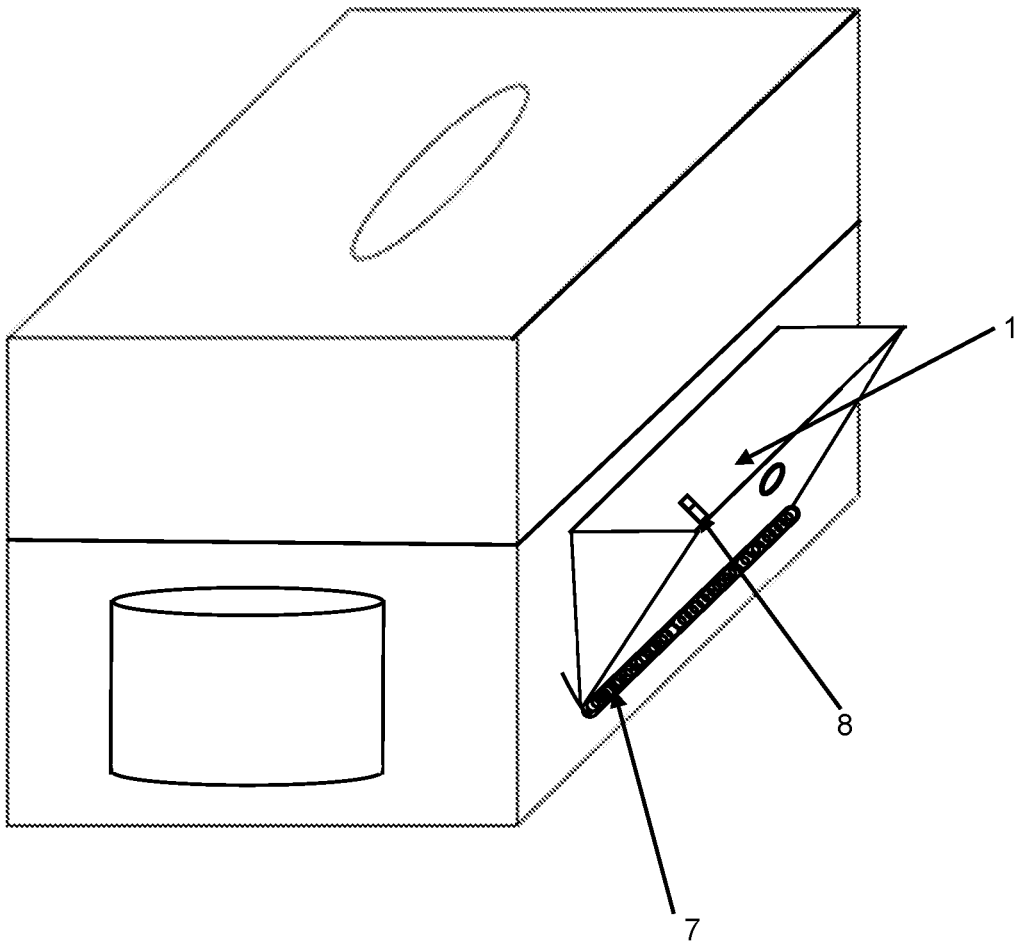
FIG. 2 is a perspective view of the container, according to an embodiment of the present invention.
Figure 3:
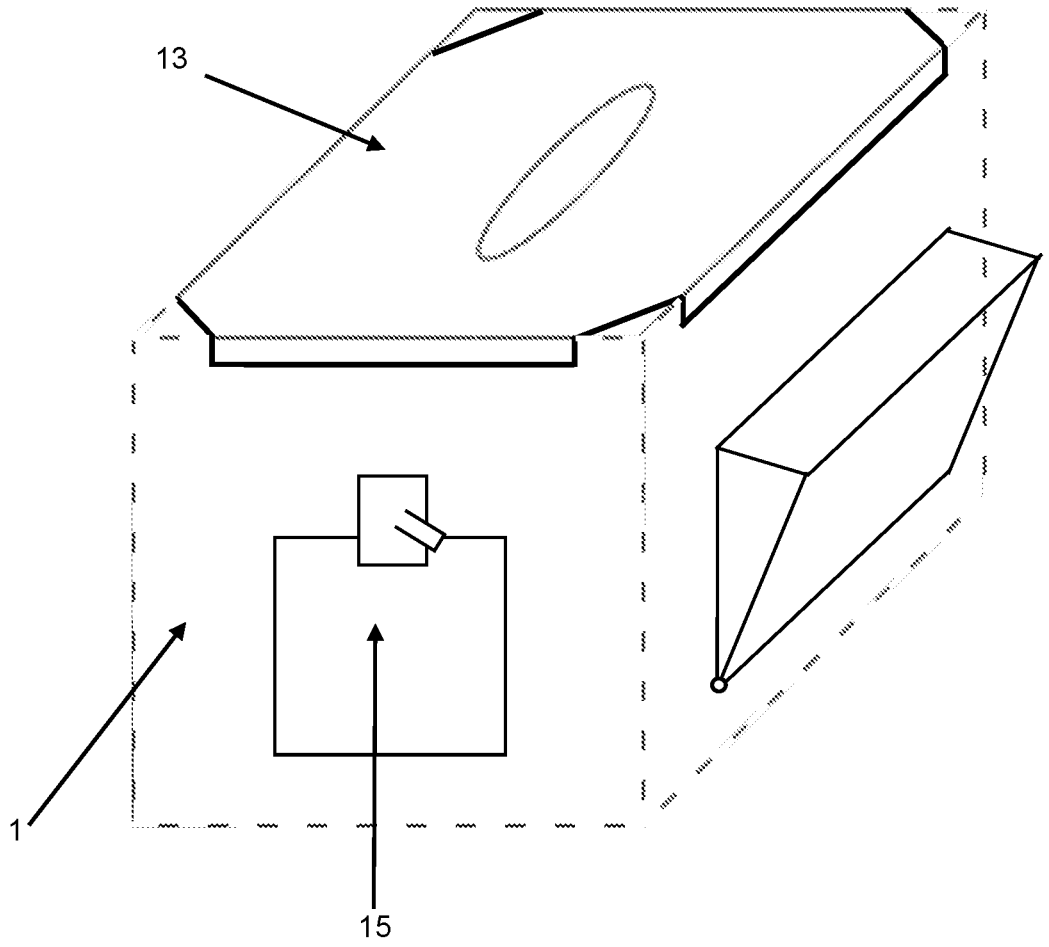
FIG. 3 is a perspective view of the container, according to an embodiment of the present invention.

Preferred embodiments of the present invention and their advantages may be understood by referring to FIGS. 1-3, wherein like reference numerals refer to like elements.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

A germ container has a base and a top separated by one or more sidewalls extending between the two. The container has a hollow interior and the top has an opening configured to facilitate the removal of a plurality of material strips contained therein. At least one of the sidewalls has a secondary compartment affixed to an exterior of the sidewall.

In an embodiment, FIG. 1 illustrates a compartment 1 is in communication with the sidewall and moveably positioned relative to a plane defined by the sidewall. The compartment 1 may be placed in a closed position such that an exterior surface of the compartment is coplanar with the sidewall. For example, the exterior surface is coplanar with the sidewall strap 5.

In some embodiments, the sidewall of the germ container has an opening defined by a perimeter in a corresponding geometric shape as the compartment.

FIG. 2 illustrates the compartment 1 may be hingedly connected to the sidewall whereby one or more pins 7 extend outwards from the perimeter of the sidewall opening. The pins are coaxially aligned with one another and contact sides of the compartment such that the compartment rotates about an axis defined by the pins. In such an embodiment, the compartment may have a tab 8 disposed on an upper surface configured to engage the upper perimeter of the sidewall opening when in a closed position. A spring may bias the compartment into an open position and the tab works against the spring bias, when the compartment is closed. To open the compartment, the user may press on the compartment towards the hollow interior of the container. The tab releases the upper perimeter and the spring then biases the compartment into an open position where the exterior surface of the compartment is positioned at an acute angle relative to the plane of the sidewall.

In an embodiment, the compartment is used to accept soiled material after it has been removed from the hollow interior of the container.

In another embodiment, the materials within the container are saturated with an antimicrobial or antibacterial solution. There may a combination of the solutions based on the use of the solution to treat or prevent known microbes or pathogens.

In an embodiment, there are multiple compartments, as described above positioned throughout the sidewalls of the container. The compartments may provide for additional storage of cleaning compounds or material to be used in combination with the material strips disposed within the hollow interior of the container.

In an alternative embodiment, the present container provides for a germ containment and management system having a first container with tissues or other material disposed therein for physical removal of microorganisms. The tissues may be saturated or impregnated with anti-microbial material or other chemical agent for optimum results. Integrated with the first container are one or more supplemental containers or compartments where used tissues are discarded and/or other materials, lotions, chemicals are presented for use in combination with the tissues disposed in the first container.

In an embodiment, FIG. 1 illustrates a box 10, such as a tissue box, is positioned in a sleeve 11 or band of material configured to engage an exterior surface of the box. The sleeve of band is defined by a continuous length of material. The additional containers 3 configured to hold used tissue and provide for storage of antibacterial materials may be attached to an exterior surface of the band or sleeve. Each of the additional containers may be rigid or resilient. Where the additional containers are resilient, they may be made of the same soft material as the band and provide for collapsible containers for easier storage. The additional containers may be defined by a bag or pouch extending into an interior of the band or sleeve whereby an opening is provided for each additional container through the band or sleeve. In such an embodiment, the opening may be sealable through spring biased and resilient members disposed around a perimeter of each opening of each additional container. The resilient members are biased towards one another in a closed position. To open, a user applies pressure at adjacent terminal ends of the resilient members in opposing directions, which results in the resilient members opening away from one another.

In another embodiment, the additional containers are releasably attached to the band of sleeve. In such an embodiment, the additional containers are attached to the band or sleeve using one or more fasteners. For example, a hook and loop attachment system may facilitate a releasable attachment between the band or sleeve and the additional containers.

In an embodiment, FIG. 3 illustrates a germ container 1 is configured to receive a box 13 of material positioned between an elastic length of material. The elastic length of material engages an exterior surface of the box.

In an embodiment, the elastic length of material is a continuous loop and flexible such that it has an adaptable geometric shape capable of contouring to the geometric shape of a box position within the elastic material loop. One or more additional elements may be attached to the elastic material loop. For example, an additional element may be a second loop or material attached to an exterior surface of the elastic loop of material configured to be engaged by a user such that the user may engage the second loop of material and carry the germ container away including the box of material retained within the elastic loop.

In an embodiment, an interior surface of the germ container is comprised of a material providing for increased friction. For example, the interior surface of the germ container, where the germ container is an elastic loop of material, is rubber or a polymer compound. The rubber or polymer compound promotes a friction fit of a box disposed within the elastic loop of material.

In an embodiment, the elastic loop of material is antimicrobial.

In another embodiment, FIG. 3 illustrates a dispenser 15 for dispensing antimicrobial or antibacterial ointments to the user such that the user can engage the dispenser and receive the ointment to clean their hands before or after use.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

We claim:

1. A container comprises:

a. a first container having a body defined by a top and bottom, wherein the top and bottom are separated by one or more sidewalls, wherein the top has an opening extending into a hollow interior;

b. a plurality of material strips sequentially disposed within the body, wherein the plurality of material strips are removed from within the body in sequential order;

c. a secondary container in communication with a band of material configured to engage the one or more sidewalls of the body of the first container, wherein the band of material separates the first container and the secondary container; wherein the secondary container receives each of the plurality of material strips after they have been removed from the body, wherein the secondary container is hingedly attached to the band of material, wherein the secondary container is selectively opened to receive each of the plurality of the material strips, and wherein the secondary container is spring biased towards the band of material to which it is hingedly attached, wherein the secondary container is opened by sufficient force in opposition to the spring bias.

2. The container of claim 1, wherein the band of material is releasably engaged to the body, wherein the band of material is an elastic loop of material, wherein the elastic loop of material engages an exterior of the one or more sidewalls.

3. The container of claim 1, wherein the secondary container is retained in a closed position by a locking mechanism attached to the one or more sidewalls.

4. The container of claim 2, further comprising a retention mechanism configured to retain one or more anti-bacterial compounds, wherein the retention mechanism is attached to the elastic loop of material.

5. The container of claim 4, wherein the retention mechanism engages an object, wherein the object is a separate container containing the one or more antibacterial compounds.

6. Then container of claim 2 further comprising one or more clips facilitating an engagement between the body and the elastic loop of material.

* * * * *